US011008874B2

(12) United States Patent
Kim

(10) Patent No.: US 11,008,874 B2
(45) Date of Patent: May 18, 2021

(54) TURBINE BLADE AND GAS TURBINE INCLUDING SAME

(71) Applicant: DOOSAN HEAVY INDUSTRIES & CONSTRUCTION CO., LTD., Changwon-si (KR)

(72) Inventor: Seok Beom Kim, Seoul (KR)

( * ) Notice: Subject to any disclaimer, the term of this patent is extended or adjusted under 35 U.S.C. 154(b) by 53 days.

(21) Appl. No.: 16/395,225

(22) Filed: Apr. 25, 2019

(65) Prior Publication Data

US 2019/0338653 A1 Nov. 7, 2019

(30) Foreign Application Priority Data

May 3, 2018 (KR) ..... 10-2018-0051068

(51) Int. Cl.

| | |
|---|---|
| ***F01D 5/20*** | (2006.01) |
| ***F01D 5/18*** | (2006.01) |
| ***F01D 11/12*** | (2006.01) |
| ***F01D 11/10*** | (2006.01) |

(52) U.S. Cl.

CPC ..... *F01D 5/20* (2013.01); *F01D 5/187* (2013.01); *F01D 11/10* (2013.01); *F05D 2240/307* (2013.01)

(58) Field of Classification Search

CPC . F01D 5/187; F01D 5/20; F01D 11/10; F05D 2240/307

See application file for complete search history.

(56) References Cited

U.S. PATENT DOCUMENTS

| | | | | |
|---|---|---|---|---|
| 6,527,514 | B2 * | 3/2003 | Roeloffs | F01D 5/186 416/97 R |
| 7,686,578 | B2 * | 3/2010 | Klasing | F01D 5/20 415/173.1 |
| 7,740,445 | B1 * | 6/2010 | Liang | F01D 5/20 415/173.5 |
| 8,182,221 | B1 * | 5/2012 | Liang | F01D 5/20 416/1 |

(Continued)

FOREIGN PATENT DOCUMENTS

| | | |
|---|---|---|
| JP | 2011-149427 A | 8/2011 |
| KR | 10-1596068 B1 | 2/2016 |

OTHER PUBLICATIONS

A Korean Office Action dated Jun. 5, 2019 in connection with Korean Patent Application No. 10-2018-0051068 which corresponds to the above-referenced U.S. application.

*Primary Examiner* — Igor Kershteyn

(57) ABSTRACT

A turbine blade includes a root to be mounted to a rotor; a platform having an inner side and an outer side, the inner side being coupled to the root; an airfoil extending from the outer side of the platform in a radial direction of the rotor and including an outer end on which a blade tip is formed; a protrusion formed in the blade tip; and a blade cooling passage that is formed inside the airfoil and communicates with an exit hole formed in the blade tip, the blade cooling passage to pass cooling fluid through the airfoil such that the cooling fluid exits the airfoil through the exit hole. The protrusion includes an outer side surface that is flush with an outer end surface of the airfoil and protrudes in a direction perpendicular to the radial direction to prevent hot combustion gas from invading the blade cooling passage.

15 Claims, 11 Drawing Sheets

(56) References Cited

U.S. PATENT DOCUMENTS

| | | | | |
|---|---|---|---|---|
| 8,414,265 | B2 * | 4/2013 | Willett, Jr. | F01D 5/145<br>416/97 R |
| 8,500,396 | B2 * | 8/2013 | Klasing | F01D 5/20<br>415/173.1 |
| 2007/0059173 | A1 * | 3/2007 | Lee | F01D 5/20<br>416/97 R |
| 2011/0123350 | A1 * | 5/2011 | Pons | F01D 5/20<br>416/241 R |
| 2015/0330228 | A1 * | 11/2015 | Quach | F01D 5/186<br>416/95 |
| 2016/0265366 | A1 * | 9/2016 | Snyder | B22D 25/02 |

* cited by examiner

TURBINE BLADE AND GAS TURBINE INCLUDING SAME

CROSS REFERENCE TO RELATED APPLICATIONS

The present application claims priority to Korean Patent Application No. 10-2018-0051068, filed on May 3, 2018, the entire contents of which are incorporated herein for all purposes by this reference.

BACKGROUND OF THE INVENTION

1. Field of the Invention

The present invention relates to a turbine blade for use in a gas turbine. More particularly, the present invention relates to a blade tip structure capable of protecting a turbine blade cooling passage from hot combustion gas.

2. Description of the Background Art

A turbine refers to a rotary mechanical device that extracts energy from a fluid, such as water, gas, or vapor, and transforms the extracted energy into useful mechanical work. A turbine is also referred to as a turbomachine with at least one moving part called a rotor assembly, which includes a shaft with blades or vanes attached. A fluid is ejected to impact the blades or vanes or to cause a reaction force of the blades or vanes, thereby moving the rotor assembly at high speed.

Turbines are categorized into hydraulic turbines using potential energy of elevated water, steam turbines using thermal energy of vapor, air turbines using pressure energy of high-pressure compressed air, and gas turbines using energy of high-pressure hot gas. Among these, a gas turbine includes a compressor, a combustor, a turbine, and a rotor.

In such a gas turbine, the compressor includes an alternating arrangement of a plurality of compressor vanes and a plurality of compressor blades, and the turbine includes an alternating arrangement of a plurality of turbine vanes and a plurality of turbine blades. Meanwhile, the combustor introduces fuel to the compressed air produced by the compressor and burns the fuel-air mixture in order to produce a high-pressure hot combustion gas to be ejected into the turbine. The ejected combustion gas passes the turbine blades to generate torque which in turn rotates the rotor. Both ends of the rotor, which is passed through the centers of the compressor, the combustor, and the turbine, are rotatably supported by bearings, with one end typically connected to the drive shaft of an electric generator. The rotor includes a plurality of compressor disks for retaining the compressor blades, a plurality of turbine disks for retaining the turbine blades, and a torque tube that transfers torque from the turbine disks to the compressor disks.

This gas turbine does not include a reciprocating mechanism such as a piston of a typical four-stroke engine. Therefore, it has no mutually frictional parts such as a piston-and-cylinder apparatus, thereby consuming an extremely small amount of lubricating oil and reducing the operational amplitude, which is a feature of reciprocating mechanisms. Thus, gas turbines have an advantage of high-speed operation.

In the gas turbine as described above, the turbine blades are directly exposed to hot combustion gas. Therefore, a turbine blade cooling method is used in which the turbine blades are provided with internal cooling passages through which coolant flows. However, contemporary turbine blade cooling methods are problematic in that hot combustion gas partially invades the internal cooling passages.

SUMMARY OF THE INVENTION

Accordingly, it is an object of the present invention to provide an improved turbine blade capable of preventing combustion gas from invading a cooling passage. It is a further object to provide a gas turbine including the improved turbine blade.

In order to accomplish the objective of the present invention, according to one aspect of the present invention, there is provided a turbine blade including a root configured to be mounted to a rotor; a platform having an inner side and an outer side, the inner side being coupled to the root; an airfoil extending from the outer side of the platform in a radial direction of the rotor and including an outer end on which a blade tip is formed; a protrusion formed in the blade tip; and a blade cooling passage that is formed inside the airfoil and communicates with an exit hole formed in the blade tip, the blade cooling passage configured to pass cooling fluid through the airfoil such that the cooling fluid exits the airfoil through the exit hole.

The protrusion may protrude in a direction perpendicular to the radial direction.

The airfoil may include a pressure surface extending between leading and trailing edges of the airfoil; and a suction surface opposing the pressure surface and extending between the leading and trailing edges of the airfoil, wherein the protrusion is provided on at least one of the pressure surface and the suction surface. The protrusion may protrude in a direction perpendicular to the radial direction from only the pressure surface and may extend in an axial direction of the rotor from the leading edge to the tailing edge. The protrusion may have a height that varies from the leading edge to the trailing edge. The protrusion may have an axial cross-sectional area that varies from the leading edge to the trailing edge.

The protrusion may include an outer side surface that is flush with an outer end surface of the airfoil. The protrusion may further include an inner side surface that imparts the protrusion with a polygonal axial cross section, a rounded axial cross section having a curved contour, a chamfered shape, or a corner having an obtuse angle that is filleted.

The exit hole may consist of a plurality of exit holes each communicating with the blade cooling passage and with each other. Each of the plurality of exit holes may have an equal cross-sectional area. The plurality of exit holes may include an exit hole closest to the leading edge that has a cross-sectional area larger than other exit holes of the plurality of exit holes. The protrusion may be formed only in some number of the plurality of exit holes.

The airfoil may have a plurality of film-cooling holes placed on at least one of the suction surface and the pressure surface, wherein the film-cooling holes have the same size and are arranged at regular intervals.

According to another aspect of the present invention, there is provided a gas turbine including a compressor configured to compress air; a combustor configured to produce combustion gas by mixing fuel with the compressed air and igniting the mixture; and a turbine configured to obtain a rotary force generated by the combustion gas and to rotate the compressor using the rotary force. The turbine includes four turbine stages and a turbine blade that is consistent with the turbine blade as described above. Here, the turbine blade may consists of a plurality of turbine blades radially mounted on an outer circumferential surface of a rotor disk of only a third turbine stage of the four turbine stages.

According to the various aspects of the present invention described above, it is possible to minimize the amount of combustion gas introduced into a cooling passage by using a protrusion, thereby minimizing deterioration in durability of a turbine blade tip. Therefore, it is possible to extend the service life of a turbine blade and increase a maintenance cycle of a turbine blade.

DETAILED DESCRIPTION OF THE DISCLOSURE

Hereinbelow, a gas turbine according to an exemplary embodiment of the present invention will be described with reference to the accompanying drawings.

Figure 1:
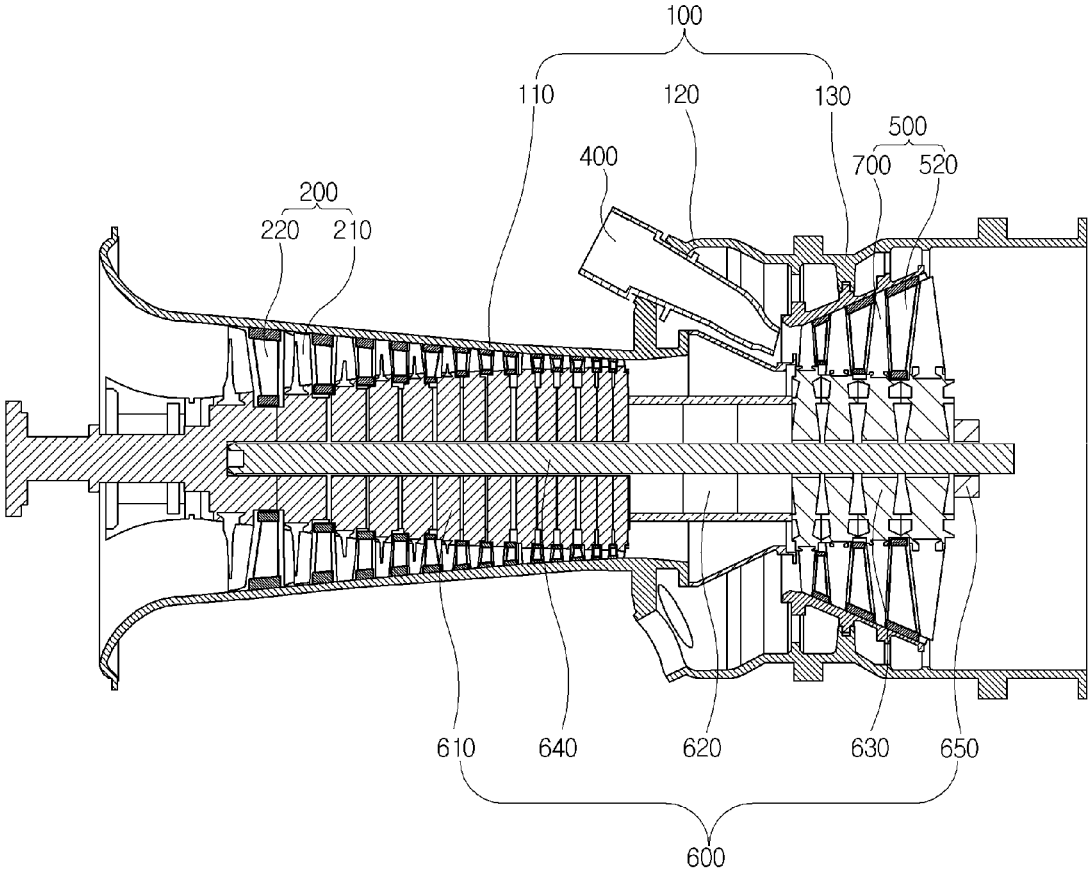
FIG. 1 is a cross-sectional view of a gas turbine in which may be applied a turbine blade according to one embodiment of the present invention.

Referring to FIG. 1, a gas turbine according to an embodiment of the present invention includes a housing 100, a rotor 600 rotatably provided within the housing 100, a compressor 200 configured to receive rotary force from the rotor 600 and to compress air introduced into the housing 100 using the rotary force, a combustor 400 configured to mix fuel with the compressed air output from the compressor 200 and ignites the resulting fuel-air mixture to produce combustion gas, and a turbine 500 configured to obtain rotary force using the combustion gas generated by the combustor and to rotate a rotor 600 using the rotary force. An electric generator (not shown) may be provided to work in conjunction with the rotor 600, and a diffuser is configured to discharge the combustion gas passing through the turbine 500 to the atmosphere.

The housing 100 includes a compressor housing 110 for accommodating the compressor 200, a combustor housing 120 for accommodating the combustor 400, and a turbine housing 130 for accommodating the turbine 500. The compressor housing 110, the combustor housing 120, and the turbine housing 130 are arranged in this order from the upstream side to the downstream of a fluid flow.

The rotor 600 includes a compressor disk 610 accommodated in the compressor housing 110, a turbine disk 630 accommodated in the turbine housing 130, a torque tube 620 accommodated in the combustor housing 120 and connected between the compressor disk 610 and the turbine disk 630, and a tie rod 640 and fixing nuts 650 that fasten the compressor disk 610, the torque tube 620, and the turbine disk 630.

There is an array of compressor disks 610 arranged in an axial direction of the rotor. The compressor disks 610 are arranged in multiple stages. Each of the compressor disks 610 has a disk shape. An outer surface of each compressor disk 610 is provided with a plurality of compressor disk slots to be respectively engaged with a plurality of compressor blades 210. Each compressor disk slot may have a fir-tree shape to prevent the compressor blade 210 from escaping in a radial direction of the rotor from the corresponding compressor disk slot.

The compressor blades 210 may be fastened to the compressor disks tangentially or axially and are fastened axially in the present embodiment. Each compressor disk 610 has multiple compressor disk slots that are radially arranged along a circumferential direction of the compressor disk 610.

The turbine disks 630 are configured in a manner similar to the compressor disks 610. That is, multiple turbine disks 630 are arranged in the axial direction of the rotor in multiple stages, for example, four stages, as a typical maximum number of turbine stages. Each of the turbine disks 630 has a disk shape and is provided with a plurality of turbine disk slots to be respectively engaged with a plurality of turbine blades 700. The turbine disk slots may have a fir-tree shape to prevent the turbine blades from escaping in the direction of rotation of the rotor from the turbine disk slots.

The turbine blades 700 to be described in detail below may be fastened to the turbine disks 630 tangentially or axially and are fastened axially in the present embodiment. In the present embodiment, each turbine disk 630 has multiple turbine disk slots that are radially arranged along a circumferential direction of the turbine disk 630.

The torque tube 620 is a torque transfer member that transfers the rotary force of the turbine disks 630 to the compressor disks 610. One end of the torque tube 620 is fastened to the farthest downstream compressor disk 610 among the plurality of compressor disks 610, and the other end is fastened to the fastest upstream turbine disk 630 among the plurality of turbine disks 630. The ends of the torque tube 620 are provided with respective protrusions, and the compressor disk 610 and the turbine disk 630 have respective recesses to engage with the protrusions, respectively. Since the protrusions of the torque tube 620 are engaged with the recesses of the compressor disk 610 and the turbine disk 630, relative rotation of the torque tube 620 with respect to the compressor disk 610 and the turbine disk 630 is prevented.

The torque tube 620 is formed in the shape of a hollow cylinder so that the air supplied from the compressor 200 can flow to the turbine 500 through the torque tube 620. In addition, the torque tube 620 needs to be immune from deformation, distortion, or twisting in a gas turbine that operates continuously for a long period of time. Furthermore, the torque tube 620 is formed to be easily assembled and disassembled for easy maintenance.

The tie rod 640 is installed to extend through the multiple compressor disks 610, the torque tube 620, and the multiple turbine disks 630. One end of the tie rod 640 is fitted in the farthest upstream compressor disk 610, and the other end protrudes downstream from the farthest downstream turbine disk 630 and is tightened with the fixing nut 650.

The fixing nut 650 presses the farthest downstream turbine disk 630 toward the compressor 200 to minimize the distance between the farthest upstream compressor disk 610 and the farthest downstream turbine disk 630. Thus, the compressor disks 610, the torque tube 620, and the turbine disks 630 can be compactly arranged in the axial direction. Therefore, the axial movement and the relative rotation of the compressor disks 610, the torque tube 620, and the turbine disks 630 are prevented.

Although the present embodiment provides a configuration in which one tie rod 640 passes through the centers of the multiple compressor disks 610, the torque tube 620, and the multiple turbine disks 630, the present invention is not limited to such a configuration. That is, in another embodiment, the compressor 200 and the turbine 500 may be provided with respective tie rods. In a further embodiment, multiple tie rods may be arranged in a circumferential direction. In addition, a combination of these configurations is also possible.

Both ends of the rotor 600 are rotatably supported by bearings. One end of the rotor 600 may be connected to a drive shaft of the electric generator.

The compressor 200 includes the compressor blades 210 that rotate in conjunction with the rotor 600 and the compressor vanes 220 fixed to the inner surface of the housing 100 to guide the flow of air supplied to the compressor blades 210. That is, the compressor blades 210 are arranged in multiple stages along the axial direction of the rotor, and in each stage, multiple compressor blades are radially arranged around the rotor 600.

Each of the compressor blades 210 includes a compressor blade platform having a flat plate shape, a compressor blade root radially extending from the compressor blade platform toward the radial center of the rotor, and a compressor blade airfoil radially extending from the compressor blade platform toward the centrifugal side of the rotor.

The compressor blade platform of one compressor blade is in contact with the compressor blade platform of the next compressor blade. Therefore, the compressor blade platforms function to space adjacent compressor blade airfoils from each other.

The compressor blade roots are of the axial type that is inserted into the respective compressor disk slots in the axial direction of the rotor. The compressor blade roots may have a fir-tree shape so as to be correspondingly engaged with the respective compressor disk slots. However, the present disclosure is not limited to such an embodiment, and the compressor blade roots and the compressor disk slots may have a dovetail shape. Alternatively, the compressor blades 210 can be fastened to the compressor disk 610 by a coupling means such as a key or a bolt. Although not illustrated, the compressor blade root may be retained in the compressor disk slot by a pin which prevents the compressor blade root from escaping from the compressor disk slot in the axial direction of the rotor.

The compressor disk slot may be formed to be slightly larger than the compressor blade root to facilitate their mutual engagement. In the engaged state, there is a clearance between the surface of the compressor blade root and the surface of the compressor blade coupling slot.

The compressor blade airfoil has an optimum shape according to the specifications of a given type of gas turbine. The compressor vanes airfoil includes a leading edge located on the airfoil's upstream side and a trailing edge located on the downstream side, such that air enters from the leading edge side and exits from the trailing edge side.

As in the case of the compressor blades 210, multiple compressor vanes 220 are arranged in multiple stages along the axial direction of the rotor. That is, the compressor vanes 220 and the compressor blades 210 are alternately arranged in the direction of the airflow, and in each stage, multiple compressor vanes are radially arranged around the rotor 600.

Each of the compressor vanes 220 includes a compressor vane platform having an annular shape formed in the circumferential direction of the rotor and a compressor vane airfoil extending from the compressor vane platform in the radial direction. The compressor vane platform includes a root-side compressor vane platform disposed near a root of the compressor vane airfoil and fastened to the compressor housing 110 and a tip-side compressor vane platform that is disposed near a tip portion of the compressor vane airfoil and faces the rotor 600. Although the present embodiment provides a configuration including both root-side and tip-side platforms to support both the root and tip of the compressor vane airfoil to more stably support the compressor vane airfoil, the present disclosure is not limited to such a configuration. For example, a configuration is also possible in which only the root-side compressor vane platform is provided to support only the root of the compressor vane airfoil.

Each of the compressor vanes 220 further includes a compressor vane root for fastening the root-side compressor vane platform to the compressor housing 200.

The compressor vane airfoil has an optimum shape according to the specifications of a given type of gas turbine. The compressor vane airfoil includes a leading edge located on the airfoil's upstream side and a trailing edge located on the downstream side, such that air enters from the leading edge side and exits from the trailing edge side.

The combustor 400 mixes fuel with the compressed air supplied from the compressor 200 and burns the fuel-air mixture to produce high-pressure hot combustion gas having high energy. The combustion gas is heated to heat-resistant temperatures of the combustor 400 and the turbine 500 through an isobaric combustion process.

Specifically, there are multiple combustors 400 that are provided in the combustor housing 120 and are arranged in the radial direction of the rotor. Each of the combustors 400 includes a liner into which the compressed air is introduced from the compressor 200, a burner which ejects fuel toward the compressed air introduced into the liner and burns the fuel-air mixture to produce combustion gas, and a transition piece that guides the combustion gas to the turbine 500. Although not illustrated in the drawings, a deswirler serving as a guide vane is provided between the compressor 200 and the combustor 400. The deswirler functions to adjust the inlet angle of the air introduced into the combustor 400 to match the designed inlet angle.

The turbine 500 has substantially the same structure as the compressor 200.

The turbine 500 includes turbine blades 700 that rotate in conjunction with the rotor and turbine vanes 520 fixed to the inside surface of the housing 100 to guide the flow of air supplied to the turbine blades 700. That is, the turbine blades 700 are arranged in multiple stages along the axial direction of the rotor, and in each stage, multiple turbine blades are radially arranged around the rotor 600.

Each of the turbine blades 700 includes a turbine platform having a flat plate shape, a turbine blade root radially extending from the turbine blade platform toward the radial center of the rotor, and a turbine blade airfoil radially extending from the turbine blade platform toward the centrifugal side of the rotor.

The turbine blade platform of one turbine blade is in contact with the turbine blade platform of the next turbine blade. Therefore, the turbine blade platforms function to space adjacent turbine blade airfoils from each other.

The turbine blade roots are of the axial type that is inserted into the respective turbine disk slots in the axial direction of the rotor. The turbine blade roots may have a fir-tree shape so as to be correspondingly engaged with the respective turbine disk slots. However, the present disclosure is not limited to such an embodiment, and the turbine blade roots and the turbine disk slots may have a dovetail shape. Alternatively, the turbine blades 700 can be fastened to the turbine disk 630 by a coupling means such as a key or a bolt. Although not illustrated, the turbine blade root may be retained in the turbine disk slot by a pin which prevents the turbine blade root from escaping from the turbine disk slot in the axial direction of the rotor.

The turbine disk slot may be formed to be slightly larger than the turbine blade root to facilitate their mutual engagement. In the engaged state, there is a clearance between the surface of the turbine blade root and the surface of the turbine blade coupling slot.

The turbine blade airfoil has an optimum shape according to the specifications of a given type of gas turbine. The turbine blade airfoil includes a leading edge located on the airfoil's upstream side and a trailing edge located on the downstream side, such that combustion gas enters from the leading edge side and exits from the trailing edge side.

As in the case of the turbine blades 700, multiple turbine vanes 520 are arranged in multiple stages along the axial direction of the rotor. That is, the turbine vanes 520 and the turbine blades 700 are alternately arranged in the direction of the airflow, and in each stage, multiple turbine vanes are radially arranged around the rotor 600.

Each of the turbine vanes 520 includes a turbine vane platform having an annular shape formed in the circumferential direction of the rotor and a turbine vane airfoil extending from the turbine vane platform in the radial direction. The turbine vane platform includes a root-side turbine vane platform disposed near the root of the turbine vane airfoil and fastened to the turbine housing 130 and a tip-side turbine vane platform that is disposed at the tip of the turbine vane airfoil and faces the rotor 600. Although the present embodiment provides a configuration including both root-side and tip-side platforms to support both the root and tip of the turbine vane airfoil to more stably support the turbine vane airfoil, the present disclosure is not limited to such a configuration. For example, a configuration is also possible in which only the root-side turbine vane platform is provided to support only the root of the turbine vane airfoil.

Each of the turbine vanes 520 further includes a turbine vane root for fastening the root-side turbine vane platform to the turbine housing 130.

The turbine vane airfoil includes a leading edge located on the airfoil's upstream side and a trailing edge located on the downstream side, such that combustion gas enters from the leading edge side and exits from the trailing edge side.

Unlike the compressor 200, components of the turbine 500 come into contact with high-pressure hot combustion gas. Therefore, the turbine 500 needs to be equipped with a cooling means for preventing the turbine components from being damaged or deteriorated by heat of the high-pressure hot combustion gas.

Therefore, the gas turbine according to the present embodiment further includes a cooling passage via which a portion of the compressed air from the compressor 200 is extracted and then supplied to the turbine 500. The cooling passage is an external passage that is installed outside the housing 100 or an internal passage installed in the rotor. Alternatively, the cooling passage may be a combined form of an external passage and an internal passage.

Hereinafter, air that flows through the cooling passage is referred to as a cooling fluid.

The cooling passage is formed to communicate with a turbine blade cooling passage formed in the turbine blade 700 so that the turbine blade 700 can be cooled by the cooling fluid supplied through the cooling passage. The turbine blade cooling passage is formed to communicate with a film cooling hole formed in the surface of the turbine blade 700 so that the cooing fluid can be supplied to the surface of the turbine blade 700. Thus, the turbine blade 700 can be cooled by film-cooling.

The turbine vanes 520 are structurally similar to the turbine blades 700. That is, the turbine vanes 420 can be cooled by the cooling fluid supplied through the cooling passage.

To facilitate rotation of the turbine blades 700, the turbine 500 requires a tip clearance between the tip of each turbine blade 700 and a shroud (not shown) or an inner surface of the turbine housing 130. When the tip clearance is large, it is advantageous that the turbine blades 700 are surely free of interference of the turbine housing 130 but is disadvantageous in terms of leakage of the combustion gas. On the contrary, when the tip clearance is small, the opposite effects are obtained. For the combustion gas ejected from the combustor 400, there are two flows: a main passage flow passing through the turbine blade 700 and a leakage flow passing the tip clearance between the turbine blade 700 and the turbine housing 130. As the tip clearance increases, the leakage flow increases, resulting in a decrease in efficiency of a gas turbine. However, with an increased tip clearance, it is possible to prevent the interference between the turbine blade 700 and the turbine housing 130, which mainly occurs due to thermal deformation of the turbine housing 130 and the turbine blade 510 due to the heat of hot combustion gas, thereby reducing the damage of turbine blades 710 and the turbine housing 130. On the contrary, as the tip clearance decreases, the leakage flow decreases, resulting in improvement in efficiency of a gas turbine. This also comes with a drawback that the turbine blades 700 and the turbine housing 130 are more likely to be damaged because of the risk of interference between the turbine blades 700 and the turbine housing 130.

The gas turbine structured as described above operates in this manner. First, air is introduced into the housing 100 and compressed by the compressor 200. The resulting compressed air is mixed with fuel and burned by the combustor 400, generating combustion gas which is in turn introduced into the turbine 500. In the turbine 500, the combustion gas passes the turbine blades 700 to rotate the rotor 600, which drives the compressor 200 and an electric generator, and is discharged into the atmosphere via a diffuser. That is, part of the mechanical energy generated by the turbine 500 is used as an energy source for air compression in the compressor 200 and the reminder is used to drive the electric generator to generate electricity.

Figure 2:
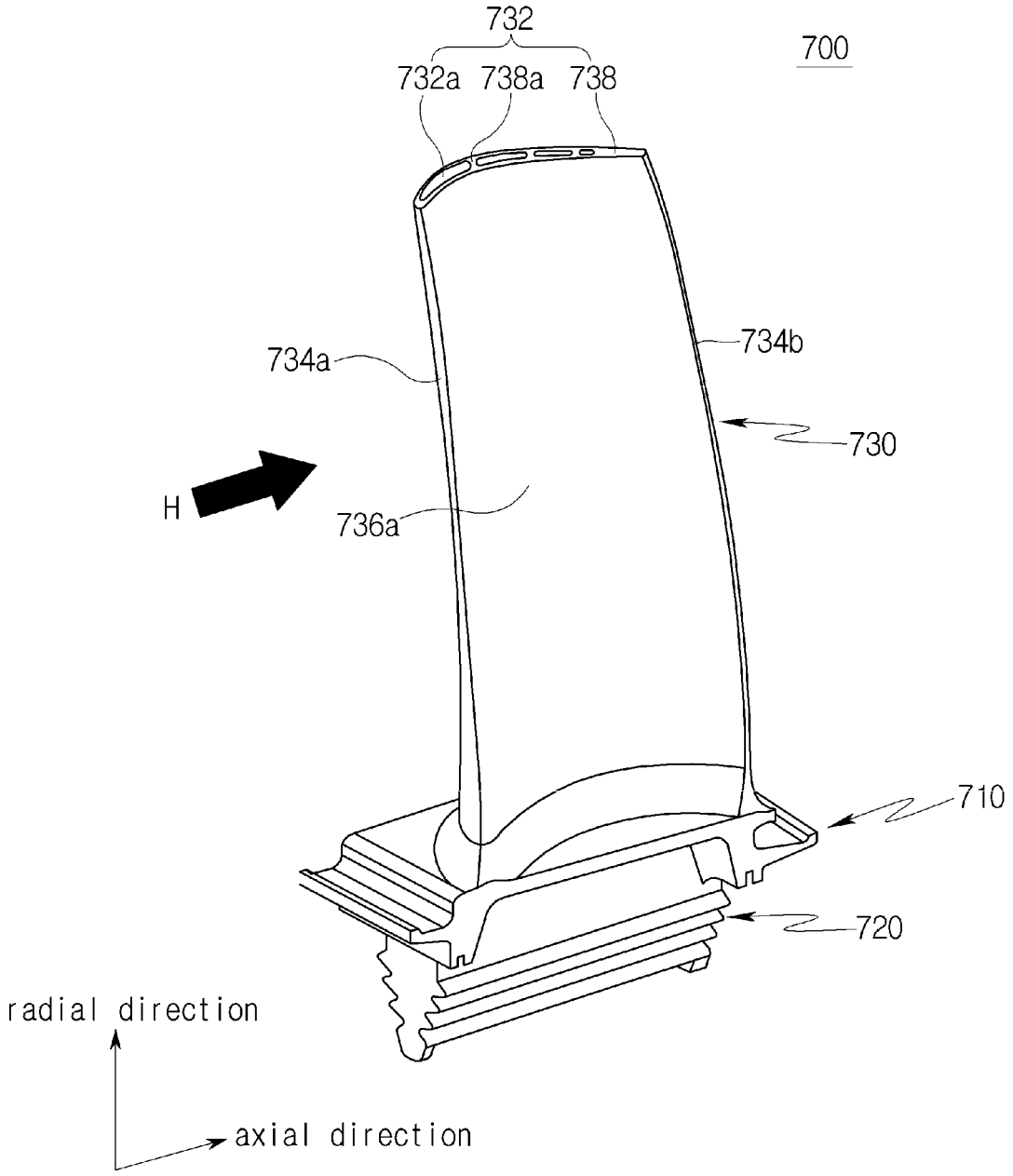
FIG. 2 is a perspective view of a turbine blade according to one embodiment of the present invention.
Figure 3:
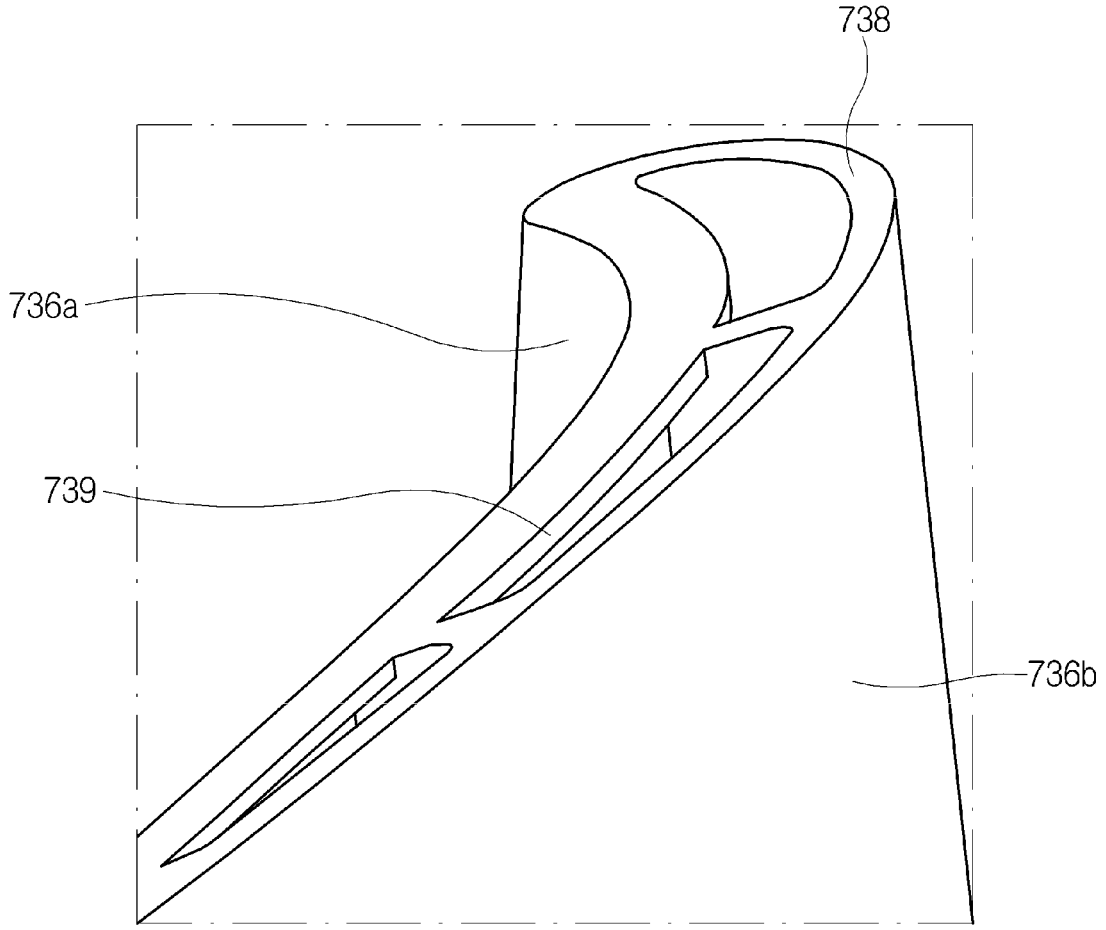
FIG. 3 is a perspective view of a blade tip of the turbine blade of FIG. 2.
Figure 4:
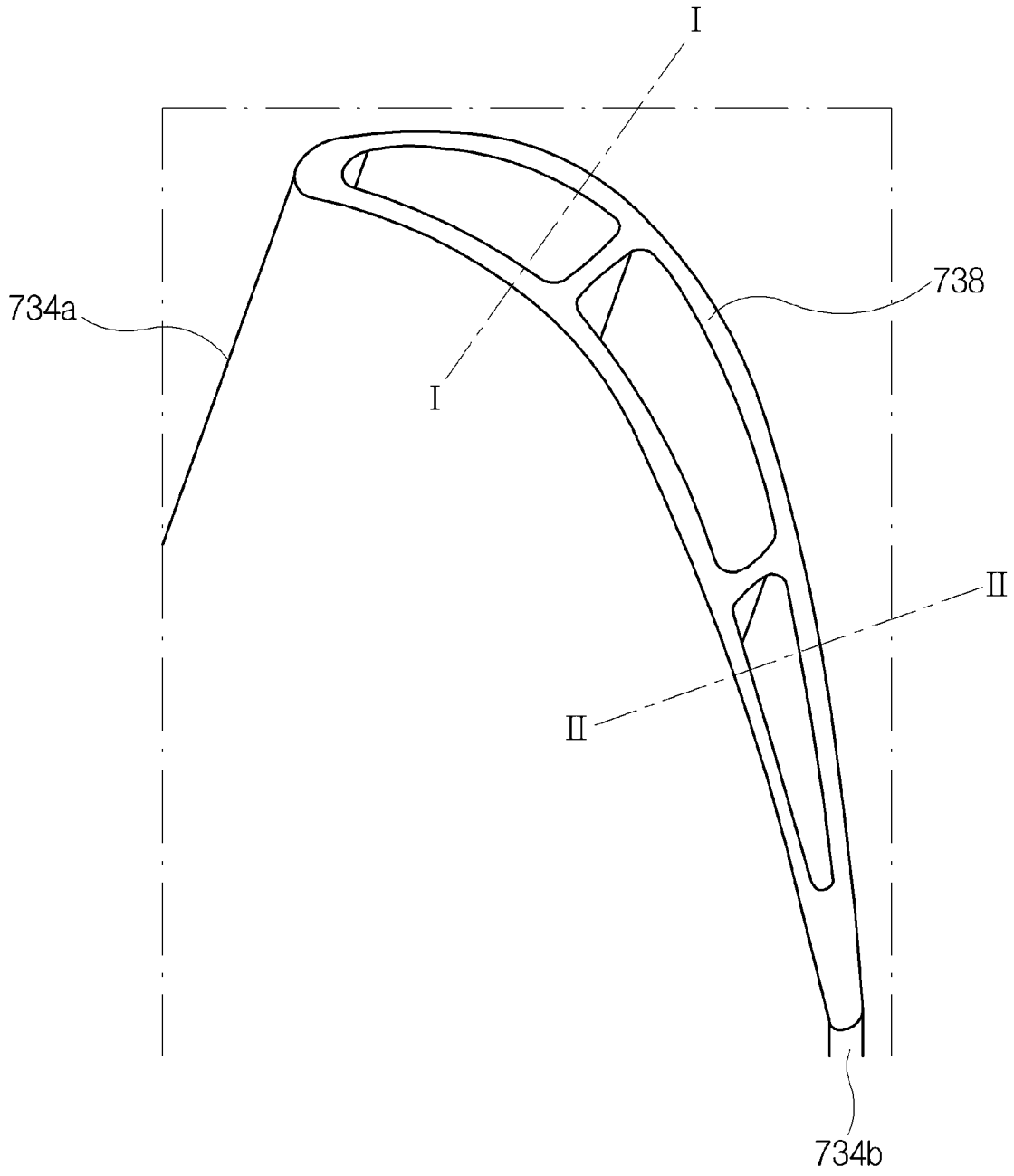
FIG. 4 is a perspective view of the blade tip of FIG. 2 viewed from a different angle from that of FIG. 3.

As illustrated in FIGS. 2-4, the turbine blade (hereinafter also referred to as blade 700) according to the present embodiment includes the turbine blade platform (hereinafter also referred to as platform 710), the turbine blade root (hereinafter also referred to as root 720), the turbine blade airfoil (hereinafter also referred to as airfoil 730), and the turbine blade tip (hereinafter also referred to as blade tip 738).

In the present disclosure, the term "radial direction" refers to the direction of a radius of the rotor 600, and the term "axial direction" refers to the longitudinal direction of a rotary shaft of the rotor 600. The radial direction and the axial direction are illustrated in FIG. 2.

The inner side of the platform 710 is combined with the root 720 in the radial direction, the outer side of the platform 710 is combined with the airfoil 730 in the radial direction, and the root 720 is combined with the rotor 600 in the radial direction. In the present disclosure, inner sides/ends are closer to the rotary shaft of the rotor 600 in the radial direction, and outer sides/end are farther away from the rotary shaft of the rotor 600 in the radial direction. Thus, the blade tip 738 is formed on an outer side of the airfoil 730.

The platform 710 has a plate structure in which a plurality of layers is laminated. In the present embodiment, the platform 710 has a rectangular shape. Alternatively, the platform 710 may have a C-shape or S-shape such that part or all of the side contour of the platform may have a curved shape. Each of the platforms 710 has a recessed side surface so that adjacent platforms can be tightly fastened with each other when the blades 700 are combined with the rotor.

The outer side of the root 720 is attached to the platform 710, and the inner side of the root 720 protrudes in the radial direction to be engaged with the turbine disk 630. That is, the turbine blade 700 is fastened to the rotor 600 by the root 720. The root 720 is covered with a coating layer so that the root 720 can be protected from the hot gas H.

The root 720 needs to be designed to withstand centrifugal stress during rotation of the rotor 600. Thus, the root 720 has a fir tree-shaped protrusion so as to be well engaged with the turbine disk slot of the turbine disk 630.

The inside of the airfoil 730 is provided with a turbine blade cooling passage (hereinafter also referred to as blade cooling passage 732) through which the cooling fluid flows to protect the airfoil 730 from the hot combustion gas. One or more exit holes 732*a* of the blade cooling passage 732 communicate with an outer surface of the blade tip 738 and are configured to discharge the cooling fluid from the airfoil 730 out through the blade tip 738. Inside the airfoil 730, the one or more exit holes 732*a* communicate with each other as well as with the blade cooling passage 732. The number and form of the exit holes 732 depend on the structure of the blade cooling passage 732. That is, although the exit holes 732*a* may all have an equal size, the configuration of the exit holes 732*a* preferably vary in size to increase the cooling efficiency of the turbine blade 700, with the size of an exit hole nearest a leading edge 734*a* being the largest and the sizes of the other exit holes gradually decreasing toward a trailing edge 734*b*.

The airfoil 730 has a pressure surface 736*a* on which the hot gas H impacts and a suction surface 736*b* on the opposite side of the pressure surface 736*a*. The pressure surface 736 and the suction surface 736*b* both extend from the leading edge 734*a* to the trailing edge 734*b*. In order to facilitate rotation of the blade 700, the pressure surface 736*a* has a concave shape and the suction surface 736*b* has a convex shape.

Figure 5A:
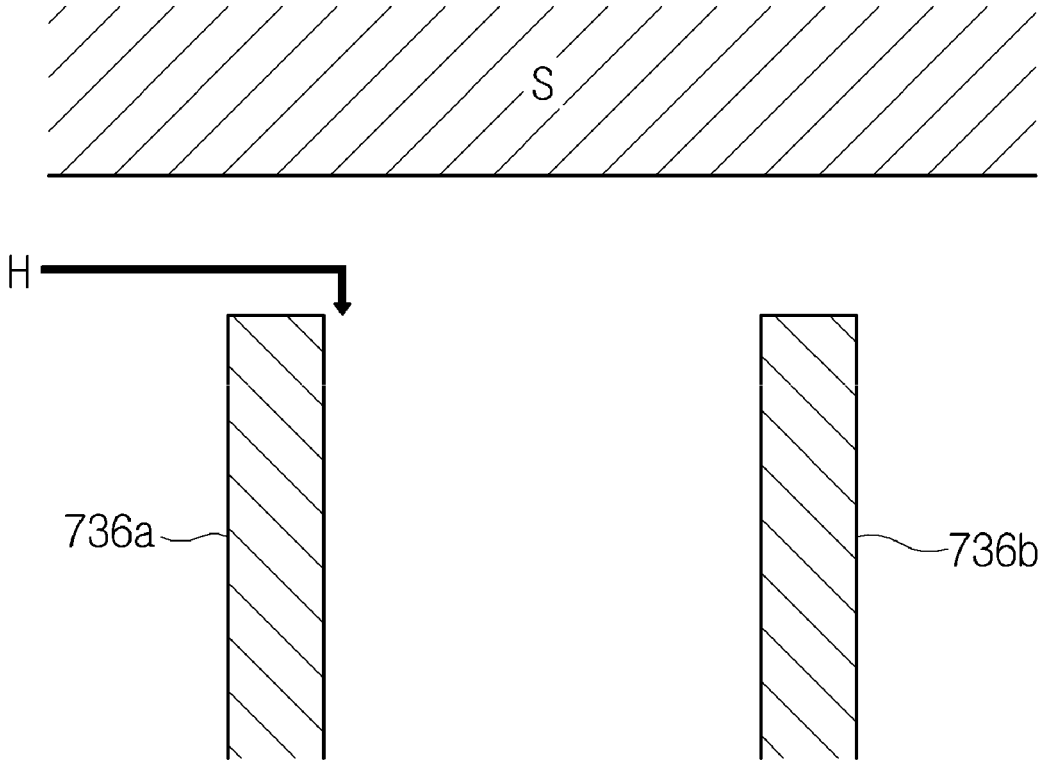
FIGS. 5A and 5B are cross-sectional views of the tip clearance between the blade cooling passage and a shroud, respectively illustrating hot gas flow with and without a protrusion positioned in the exit hole of the blade cooling passage.

The blade tip 738 forms an outer end surface of the airfoil 730 in the radial direction and has an airfoil shape. A predetermined tip clearance is established between the blade tip 738 and a shroud S (see for example FIG. 5A) positioned outside the airfoil 730 in the radial direction so as to surrounds the plurality of the blades 700.

The blade tip 738 may include at least one rib 738*a* extending between the pressure surface 736*a* and the suction surface 736*b* so that two or more exit holes 732*a* are formed. That is, the ribs 738*a* may be provided between the exit holes 732*a*.

According to the turbine blade 700 of the present invention, the blade tip 738 is provided with the exit holes 732*a* of the blade cooling passage 732, and the flow rate of a cooling fluid is regulated by a throttle plate (not shown).

When hot combustion gas H flows over the blade tip 738 and passes via the tip clearance next to the shroud S, there is a risk that the hot gas H is introduced into the blade cooling passage 732. In this case, the blade cooling passage 732 is subject to excessive heat and may be damaged by the hot gas H. Therefore, inside wall surfaces of the blade cooling passage 732 may be coated with an anti-oxidation material to protect the blade cooling passage 732 from damage. However, the anti-oxidation coating has a problem of inducing cracking.

Figure 5B:
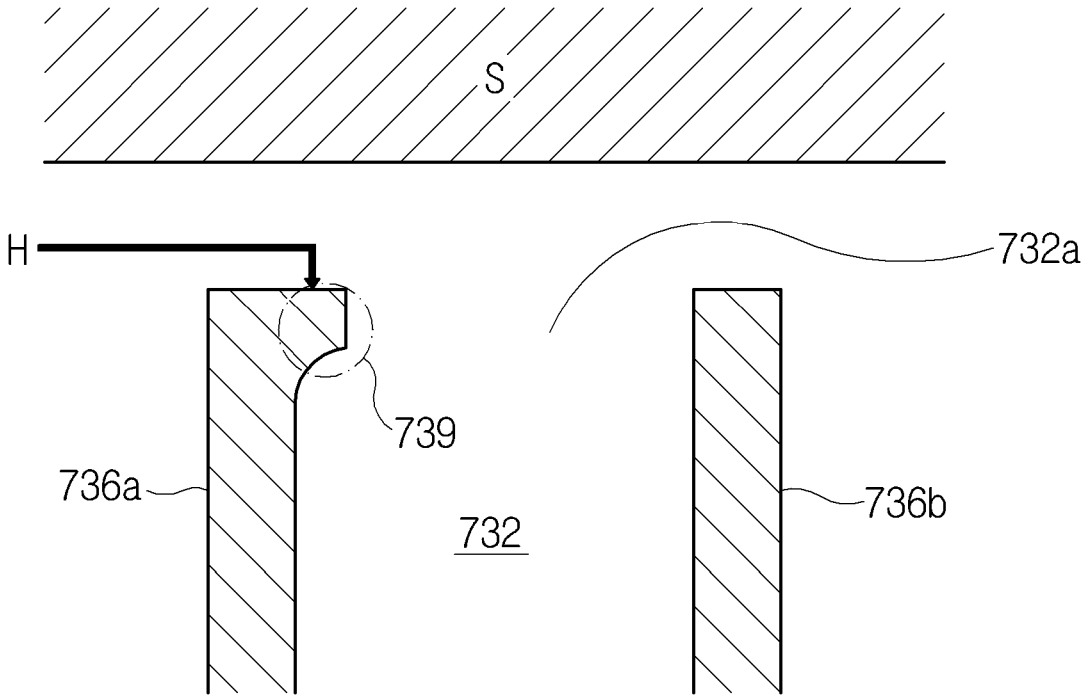

As shown in FIG. 5B, in order to solve the problems described above, the turbine blade 700 according to one embodiment of the present invention has a protrusion 739 that protrudes in the axial direction from an inside surface of the blade tip 738 by a predetermined axial distance (height). That is, the protrusion 739 protrudes toward the center of the blade cooling passage 732. The protrusion 739 is preferably formed on the pressure surface side to effectively achieve the objective of preventing invasion of the hot gas. The protrusion 739 is preferably formed in each of the one or more exit holes 732*a*, but may be formed in only some number of the exit holes 732*a* and not in others. The protrusion 739 is formed to have an outer side surface that is flush with the outer end surface of the airfoil 730, and an inner side surface that may vary according to a preferred embodiment.

Figure 7A:
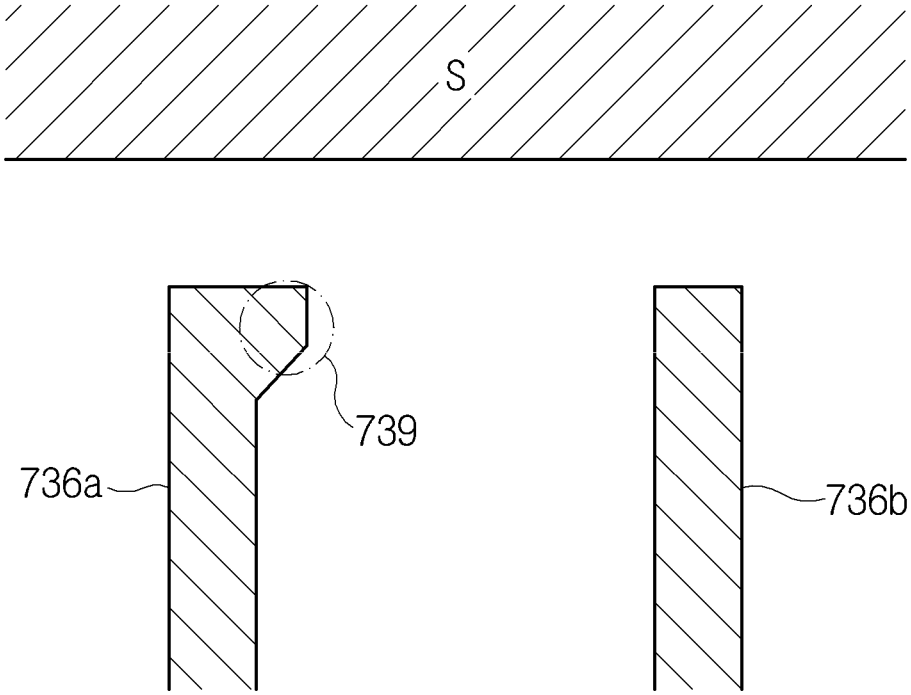
FIGS. 7A to 7C are cross-sectional views of a blade tip of a turbine blade according to various embodiments of the present invention.
Figure 7B:
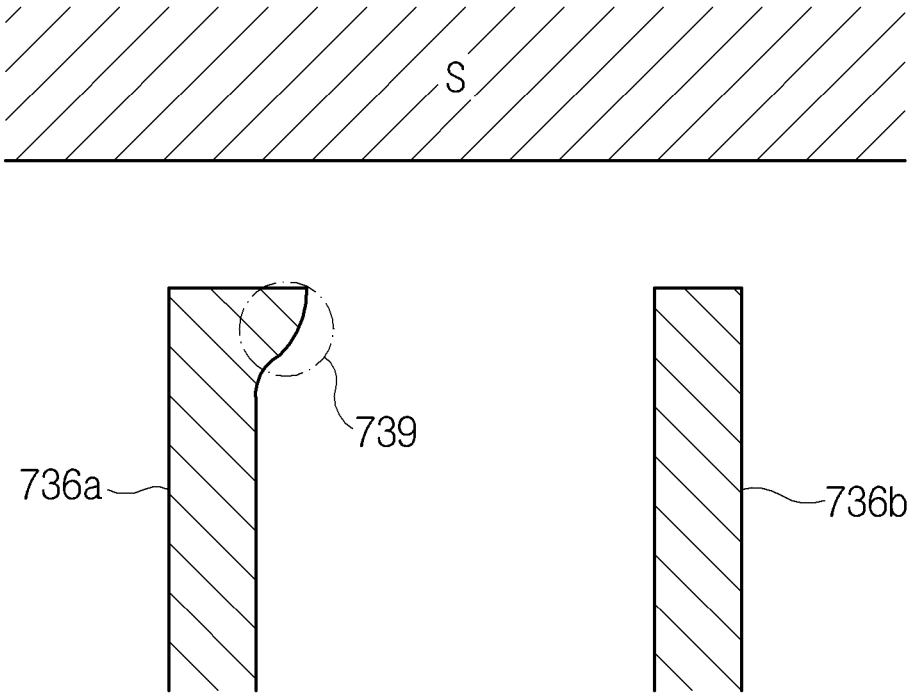
Figure 7C:
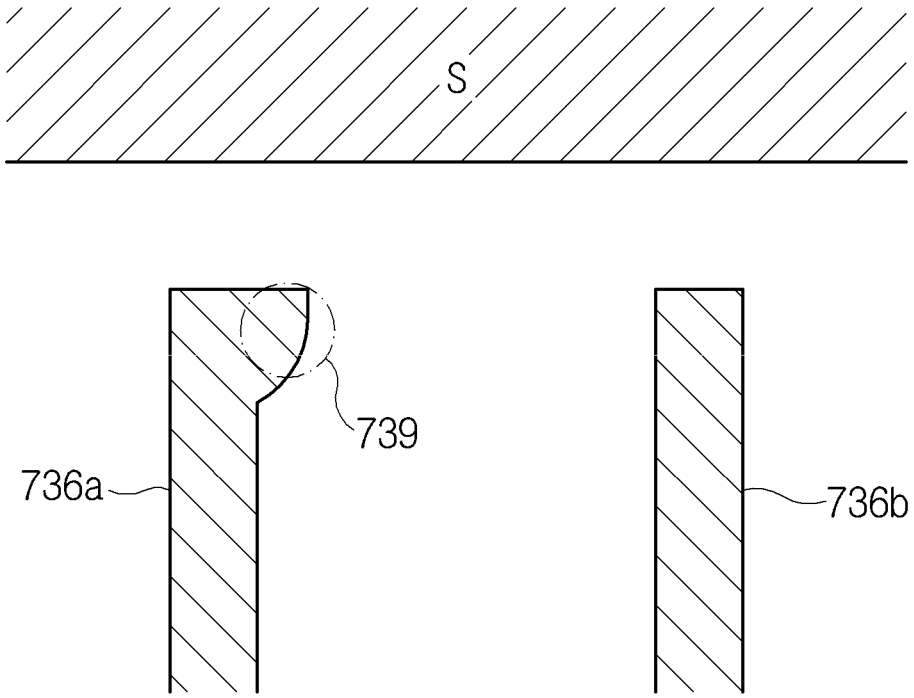

As illustrated in FIGS. 7A to 7C, according to embodiments of the present invention, the protrusion 730 has a polygonal cross section such as a trapezoidal cross section or a partially rounded cross section. However, the shape and size of the protrusion 739 are not particularly limited, as long as they have an effect of preventing invasion of the hot gas H into the blade cooling passage.

When forming the protrusion 739, chamfering or filleting may be performed. For example, when the protrusion 739 has a trapezoidal cross section, a corner having an obtuse angle may be filleted. The precise dimension to be chamfered or filleted is determined by taking into account the effect on the flow of the cooling fluid by the protrusion 739.

Figure 6A:
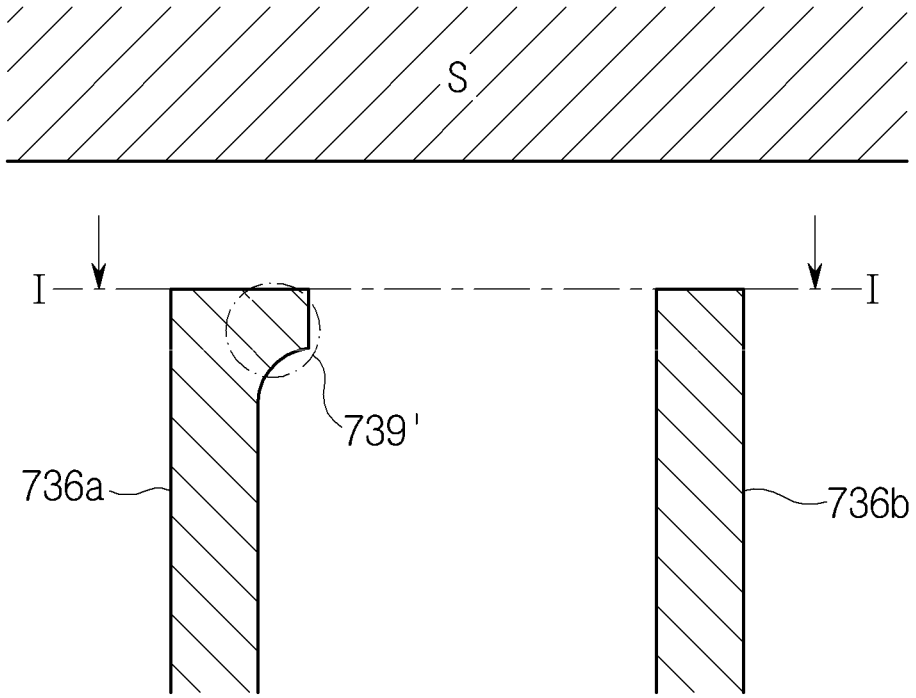
FIG. 6A is a cross-sectional view taken along a line I-I of FIG. 4.
Figure 6B:
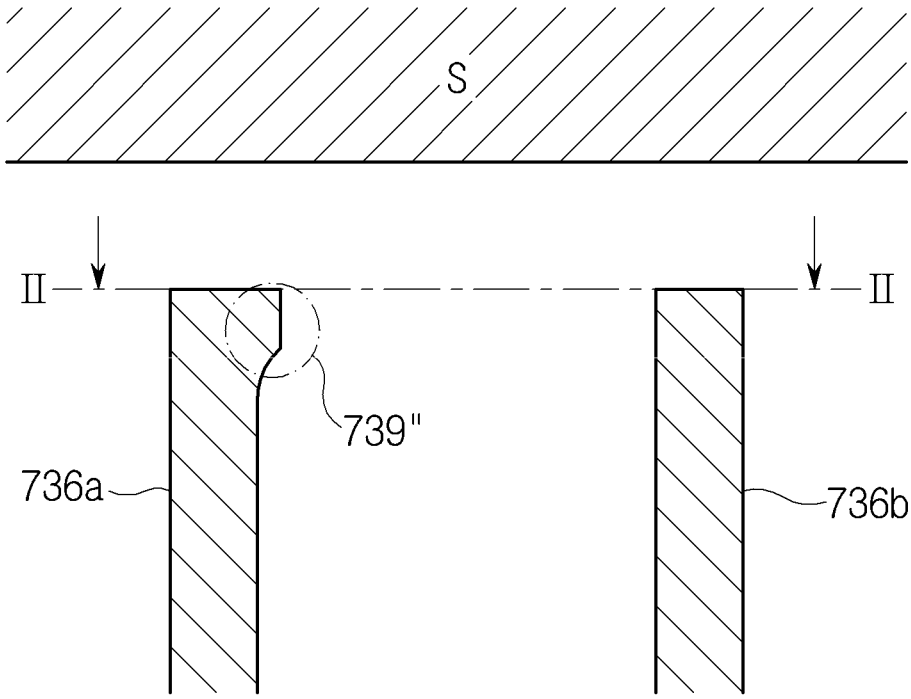
FIG. 6B is a cross-sectional view taken along a line II-II of FIG. 4.

As illustrated in FIGS. 6A and 6B, the height of the protrusion 739, i.e., its protruding distance, may vary from a position near the leading edge 734*a* (as in FIG. 6A) to a position near the trailing edge 734*b* (as in FIG. 6A). According to the present embodiment, the height of the protrusion 739 increases (739') with a decreasing distance from the leading edge 734*a* and decreases (739") with a decreasing distance from the trailing edge 734*b*. Alternatively, the protrusion 739 may be formed conversely, that is, to have a decreasing height with a decreasing distance from the leading edge 734*a* and an increasing height with a decreasing distance from the trailing edge 734*b*. Further alternatively, the height of the protrusion 739 may be uniform from the leading edge 734*a* to the trailing edge 734*b*.

As illustrated in FIG. 5B, when the blade tip 738 has the protrusion 739, the protrusion 739 can prevent the hot gas H flowing through the turbine tip clearance from invading the blade cooling passage 732.

The protrusion 739 is formed unitarily with the airfoil 730. That is, the airfoil 730 having the protrusion 739 is manufactured through a casting process. Therefore, it is not necessary to perform an additional process such as welding to attach the protrusion 739 to the airfoil 730.

Since the hot gas H flows along the pressure surface 736*a*, that is, from the leading edge 734*a* to the trailing edge 734*b*, the protrusion 739 is preferably formed on the pressure surface 736*a* side of the blade tip 738.

According to the embodiments of the present invention, at least one of the pressure surface 736*a* and the suction surface 736*b* is provided with a plurality of film cooling holes to increase the blade cooling efficiency. The film cooling holes have the same size and are arranged at regular intervals for uniform cooling of the airfoil 730. The interval means a distance from the center of one film cooling hole to the center of the next film cooling hole.

The turbine blades 700 according to one embodiment of the present invention are preferably mounted on a third-stage turbine disk of a four-stage turbine of a gas turbine. The size of the turbine blades of a farther downstream turbine stage needs to be increased because the hot gas H gradually expands in volume in the direction of the gas flow. Therefore, a turbine blade cooling method needs to vary according to the stage at which the turbine blades are positioned. Considering this, according to the present embodiment, the turbine blades described above are preferably used only in the third stage of the turbine, but may be applied to a different stage of the turbine.

Hereinafter, operational effects of the turbine blade according to the present invention will be described.

Since the turbine blade 700 has the exit hole 732*a* of the cooling passage 732 at the blade tip 730, the blade tip 738 can be effectively cooled. A portion of the hot gas H flows through the turbine tip clearance between the blade tip 738 and the shroud S and is blocked by the protrusion 739 from invading the blade cooling passage 732. That is, the protrusion 739 of the blade tip 738 prevents the hot gas H from invading the blade cooling passage 732, as illustrated in FIG. 5B. Therefore, the inside wall surfaces of the blade cooling passage 732 are not subject to heat damage by the hot gas H. In addition, since it is not necessary to coat the inside wall surface of the blade cooling passage 732 with an anti-oxidation coating material, the manufacturing process is simplified and the manufacturing cost is reduced. Furthermore, there is no risk of the cracking of the inside wall surface of the blade cooling passage, attributable to the anti-oxidation coating.

In addition, since the protrusion 739 is unitarily formed with the airfoil 730, the airfoil 730 with the protrusion 739 can be easily manufactured without increasing the manufacturing cost and adding a process step. According to the embodiments of the present invention, the turbine blade 700 features that the blade tip 738 is machined to have the protrusion 739 having a simple shape, thereby preventing the hot gas H from invading the blade cooling passage.

While the present disclosure has been described with respect to the specific embodiments, it will be apparent to those skilled in the art that various changes and modifications may be made without departing from the scope of the disclosure as defined in the following claims.

What is claimed is:

1. A turbine blade comprising:

a root configured to be mounted to a rotor;

a platform having an inner side and an outer side, the inner side being coupled to the root;

an airfoil extending from the outer side of the platform in a radial direction of the rotor and including an outer end on which a blade tip is formed, the airfoil including an outer end surface facing in a radially outward direction, a pressure surface extending between leading and trailing edges of the airfoil, and a suction surface opposing the pressure surface and extending between the leading and trailing edges of the airfoil;

a protrusion formed in the blade tip; and a blade cooling passage that is formed inside the airfoil and communicates with an exit hole formed in the blade tip, the blade cooling passage configured to pass cooling fluid through the airfoil such that the cooling fluid exits the airfoil through the exit hole, wherein the protrusion is provided on the pressure surface only and includes an outer side surface that faces in the radially outward direction and that is flush with the outer end surface of the airfoil.

2. The turbine blade according to claim 1, wherein the protrusion protrudes in a direction perpendicular to the radial direction.

3. The turbine blade according to claim 1, wherein the protrusion protrudes from the pressure surface in a direction perpendicular to the radial direction and extends in an axial direction of the rotor from the leading edge to the tailing edge.

4. The turbine blade according to claim 3, wherein the protrusion has a height that varies from the leading edge to the trailing edge.

5. The turbine blade according to claim 3, wherein the protrusion has an axial cross-sectional area that varies from the leading edge to the trailing edge.

6. The turbine blade according to claim 1, wherein the protrusion further includes an inner side surface that imparts the protrusion with a polygonal axial cross section.

7. The turbine blade according to claim 1, wherein the protrusion further includes an inner side surface that imparts the protrusion with a rounded axial cross section having a curved contour.

8. The turbine blade according to claim 1, wherein the protrusion further includes an inner side surface that imparts the protrusion with a chamfered shape.

9. The turbine blade according to claim 1, wherein the protrusion further includes an inner side surface that imparts the protrusion with a corner having an obtuse angle that is filleted.

10. The turbine blade according to claim 1, wherein the exit hole consists of a plurality of exit holes each communicating with the blade cooling passage.

11. The turbine blade according to claim 10, wherein each of the plurality of exit holes has an equal cross-sectional area.

12. The turbine blade according to claim 10, wherein the plurality of exit holes includes an exit hole closest to the leading edge that has a cross-sectional area larger than other exit holes of the plurality of exit holes.

13. The turbine blade according to claim 10, wherein the protrusion is formed only in some number of the plurality of exit holes.

14. A gas turbine comprising:

a compressor configured to compress air;

a combustor configured to produce combustion gas by mixing fuel with the compressed air and igniting the mixture; and a turbine configured to obtain a rotary force generated by the combustion gas and to rotate the compressor using the rotary force, the turbine including four turbine stages and a turbine blade comprising:

a root configured to be mounted to a rotor;

an airfoil extending from the outer side of the platform in a radial direction of the rotor and including an outer end on which a blade tip is formed, the airfoil including an outer end surface facing in a radially outward direction, a pressure surface extending between leading and trailing edges of the airfoil, and a suction surface opposing the pressure surface and extending between the leading and trailing edges of the airfoil;

a protrusion formed in the blade tip; and a blade cooling passage that is formed inside the airfoil and communicates with an exit hole formed in the blade tip, the blade cooling passage configured to pass cooling fluid through the airfoil such that the cooling fluid exits the airfoil through the exit hole, wherein the protrusion is provided on the pressure surface only and includes an outer side surface that faces in the radially outward direction and that is flush with the outer end surface of the airfoil.

15. The gas turbine according to claim 14, wherein the turbine blade consists of a plurality of turbine blades radially mounted on an outer circumferential surface of a rotor disk of only a third turbine stage of the four turbine stages.

* * * * *